US005683807A

United States Patent [19]

Röder et al.

[11] Patent Number: 5,683,807

[45] Date of Patent: Nov. 4, 1997

[54] ADHESIVE ARRANGEMENT FOR PAPER ROLL

[75] Inventors: Klaus Walter Röder; Hartwig Horst Trutschel, both of Würzburg, Germany

[73] Assignee: Koenig & Bauer Aktiengesellschaft, Wurzburg, Germany

[21] Appl. No.: 502,154

[22] Filed: Jul. 13, 1995

[30] Foreign Application Priority Data

Jul. 14, 1994 [DE] Germany ..... 44 24 902.0

[51] Int. Cl.[6] ..... B32B 3/10

[52] U.S. Cl. ..... 428/354; 242/556; 242/556.1; 428/906

[58] Field of Search ..... 242/556, 556.1; 428/343, 354, 906

[56] References Cited

U.S. PATENT DOCUMENTS

| | | | |
|---|---|---|---|
| 2,160,855 | 6/1939 | Ginssberg . | |
| 2,361,857 | 10/1944 | McMullen . | |
| 2,553,928 | 5/1951 | McMullen . | |
| 3,915,399 | 10/1975 | Kron | 242/58.1 |
| 5,318,656 | 6/1994 | Dylla | 156/357 |
| 5,323,981 | 6/1994 | Dionne | 242/58.5 |
| 5,332,607 | 7/1994 | Nakamura | 428/40 |
| 5,388,775 | 2/1995 | Duguay | 242/160.1 |

*Primary Examiner*—Jenna Davis

*Attorney, Agent, or Firm*—Jones, Tullar & Cooper, P.C.

[57] ABSTRACT

An adhesive arrangement for a paper web supply roll acts as both a holding and a connecting adhesive during a flying roll change. A leading portion of a first layer of the paper web is provided with a plurality of apertures. A double sided adhesive strip is placed on the leading portion of the first web layer and partially or completely overlies these apertures. Those portions of the adhesive strip overlying the apertures contact the second paper web layer and act as a holding adhesive.

11 Claims, 2 Drawing Sheets

ADHESIVE ARRANGEMENT FOR PAPER ROLL

FIELD OF THE INVENTION

The present invention is directed generally to an adhesive arrangement for a paper supply roll. More particularly, the present invention is directed to an adhesive arrangement for a paper web supply roll for a web-fed printing press. Most specifically, the present invention is directed to an adhesive arrangement for the leading end of a paper supply web for use in a flying roll change. The leading end of the paper web rolled on the paper supply roll is provided with a plurality of perforations or cut-outs at or adjacent its leading edge. An adhesive strip is applied to this leading end of the first layer of the paper web on the supply roll. Portions of this adhesive strip overlie the perforations or cutouts and thus engage the surface of the second paper web layer on the supply roll through these perforations or cut-outs. The adhesive strip thus functions both as a holding adhesive prior to the flying roll change and as a connecting adhesive during the roll change.

DESCRIPTION OF THE PRIOR ART

In the operation of web-fed printing presses, typically rotary printing presses, it is desirable to maintain the continuous operation of the press. When a supply roll of the paper web being printed begins to become depleted, the web from this depleting roll is connected to a leading end of a new paper web on a fresh paper web supply roll. The allow the press to continue operation during this splicing or connecting operation, this procedure being accomplished during what is called a flying roll change. As is known in the art, the leading edge of the new supply roll is prepared by using a splicing tape and the new roll is brought up to web travel speed. The depleting web is pressed against the new roll and the leading end of the new roll is adhered, by its splice tape, to the depleting web which is then severed behind the splice.

A variety of splice tapes are known in the art. In one method used for preparing a roll of web-shaped material to be used in a printing press for accomplishing a flying roll change in an automatic roll changing device, an adhesive strip is attached to the leading end of the new web. This adhesive tape or splice tape is structured having three different components along its entire length and is used to attach the start of the outermost layer of the paper web to the second layer of the paper web and is also used to attach the first layer of the new paper web to the depleting web during a flying roll change. This prior art adhesive strip may be seen in European Patent Publication No. EP 0 418 527 A1. As may be seen in that document, this prior art adhesive strip is a multi-layer assembly which is divided across its width into three different zones. The two outer zones have adhesive on them while the central zone is perforated and is free of adhesive.

This prior art adhesive strip, and others which are similar to it, are apt to cause problems to the printing presses with which they are used. Because of the application of adhesive on both sides of the tape and the addition of the tape to the material to be printed, the adhesive strip in accordance with this prior art device causes great stresses on the various cylinders when it passes through the rotary printing press. The additional thicknesses of these multiple layer adhesive strips, as they pass through the printing press, can result in permanent deformations of the blanket and this leads to premature press wear.

Another problem, which is a function of these prior art multiple layer connecting and holding adhesive strips, is that these layers must be cut by the web cutters. As the web is printed and then cut and folded, these multiple layer adhesive strips cause greater than usual wear to the linear cutters. The long term effect of this is the reduction in the service life of the cutters.

These prior art multiple layer adhesive splice tapes are typically not symmetrical across their width. These three zone tapes have a varied and thus asymmetric thickness across their width, when viewed in cross-section. These three zone tapes thus cannot be rolled in a symmetric manner. This creates a tape storage problem. It also results in the inability of the tape to be usable in an automatic feeding assembly, which is required for use in the automated preparation of the leading ends of fresh supply rolls.

It is also generally conventional in the prior art to apply a plurality of so-called closure strips to the leading edge of the fresh web. These closure strips are individually attached to the leading end of the paper web and typically extend generally at right angles to the axis of rotation of the paper web supply roll. These closure strips are used to secure the leading edge of the first paper web layer to the second paper web layer. Each such closure strip typically has to be applied individually, and, thus in a time-wasting fashion, to the start of the paper web. These closure strips also constitute an additional adhesive strip that is applied to the new supply paper roll so that the new paper roll can be connected with the web from the depleting paper web roll.

It will be apparent that a need exists for a paper web splicing tape that overcomes the limitations of the prior art devices. The adhesive arrangement for a paper roll in accordance with the present invention provides such a device and is a significant improvement over the prior art.

SUMMARY OF THE INVENTION

It is an object of the present invention to provide an adhesive arrangement for a paper web roll.

Another object of the present invention is to provide an adhesive arrangement for a new paper web supply roll in a web-fed printing press.

A further object of the present invention is to provide an adhesive arrangement for a leading end of a paper web in a supply roll for use in a flying roll change.

Still another object of the present invention is to provide an adhesive arrangement for a paper web supply roll which is free of closure strips.

Yet a further object of the present invention is to provide an adhesive arrangement for a paper web supply roll which can be easily applied in the roll changer.

Even another object of the present invention is to provide an adhesive arrangement for a paper web supply roll which passes easily through the rotary web-fed printing press.

As will be discussed in greater detail in the description of the preferred embodiments which is set forth subsequently, the adhesive arrangement for a paper web in accordance with the present invention is a single thickness, double sided adhesive strip that acts both as a holding adhesive and as a connecting adhesive. The leading end of the first layer of the paper web is provided with a plurality of apertures at or adjacent its leading edge. These apertures are sized so that portions of the adhesive strip applied to the leading end of the first paper web layer will be in contact, through these apertures, with the surface of the second layer of the paper web on the supply roll. The sizing of these apertures, and their placement on the leading edge of the first layer of the paper web acts to hold the leading end of the web in place during handling of the paper web supply roll yet allows separation of the first layer of the web from the second layer of the web during the flying roll change.

The adhesive arrangement in accordance with the present invention facilitates the connection of the first layer of the fresh paper web supply roll to the second web layer without the need for additional closure strips or the like. The single, unperforated adhesive strip of the present invention extends generally parallel to the paper web leading edge and insures that the flying roll change will be accomplished in an expeditious manner. The single adhesive strip has a reduced thickness, as compared to the various prior art devices, and passes through the printing presses and their associated cutters and folders in a damage-free manner.

The force of the adhesive holding of the first layer of the paper web to the second layer is controllable by proper selection of the number and sizing of the apertures at the leading end of the first paper web layer. It is these apertures that allow portions of the adhesive strip to engage the second paper web layer. The aperture sizes and numbers are chosen so that the force of air resistance during initial start-up and rotation of the fresh feed roll will not separate the leading end of the first web layer from the second web layer. This adhesive force will not, however be so great as to interfere with the separation of the first web layer from the second web layer during a flying roll change.

The adhesive strip used in the present invention is a single thickness strip that does not vary across its width. This means that it can be easily rolled and stored. It is also easily adapted for use with automated feeding equipment so that it can be used in automatic paper supply roll processing or make-up locations.

The adhesive arrangement for a paper web roll in accordance with the present invention overcomes the limitations of the prior art. It is a substantial advance in the art.

BRIEF DESCRIPTION OF THE DRAWINGS

While the novel features of the adhesive arrangement for a paper web roll in accordance with the present invention are set forth with particularity in the appended claims, a full and complete understanding of the invention may be had by referring to the detailed description of the preferred embodiments, which is presented subsequently, and as illustrated in the accompanying drawings, in which:

DETAILED DESCRIPTION OF THE PREFERRED EMBODIMENTS

Figure 1:
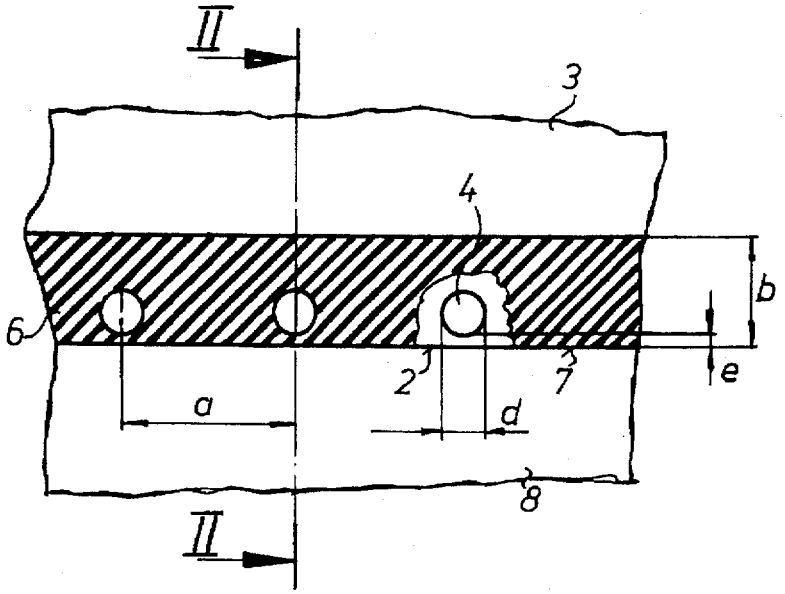
FIG. 1 is a partial top plan view of a first preferred embodiment of an adhesive arrangement at a start of a paper web supply roll in accordance with the present invention.
Figure 2:
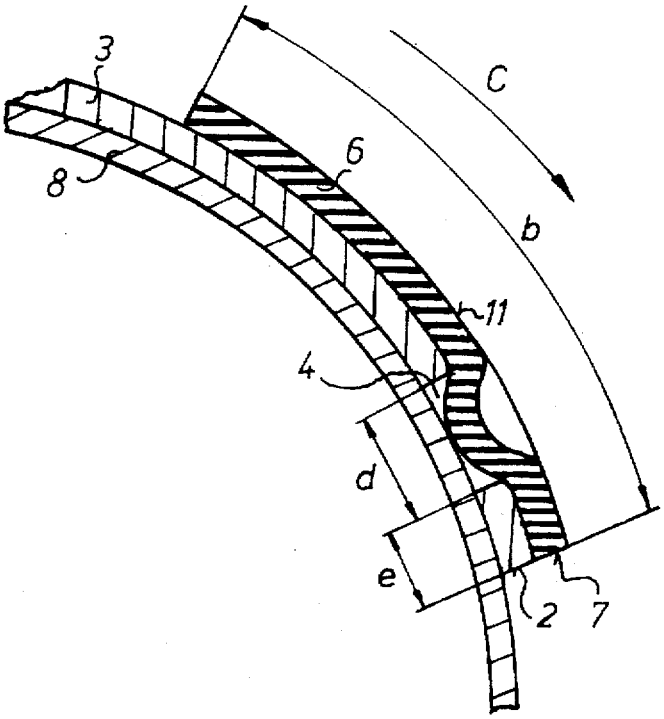
FIG. 2 is an enlarged cross sectional view of the adhesive arrangement and taken along line II—II of FIG. 1.

Referring initially to FIGS. 1 and 2, there may be seen a first preferred embodiment of an adhesive arrangement for a paper web roll in accordance with the present invention. The paper web roll is intended for use in a flying roll change to be connected with a paper web (not shown) from a depleting paper web roll. The fresh paper web supply roll has a leading end 2 of a paper web. This leading end 2 of the first or outer layer 3 of the paper web wound on the fresh paper web supply roll has a plurality of apertures, which in the first embodiment are a plurality of perforations 4 that are spaced along the axially extending length of the leading end 2 of the first layer 3 of the paper web. These perforations 4 are adjacent a leading edge of the paper web start or leading end 2 but do not touch the paper web leading edge. The forward most, in the direction of paper web feed off the supply roll, portion of each perforation 4 is spaced at a small distance "e" from the leading edge of the leading end 2 of the upper or first paper web layer 3. These perforations 4 are preferably circular in cross-section. However, they could also be oval, triangular, rectangular or of any other arbitrary geometrical shape.

A two sided adhesive strip 6 is applied to the leading end 2 of the first layer 3 of the paper web on the paper web supply roll. The adhesive strip overlies the perforations 4 and has a leading edge 7 that extends parallel to the leading edge of the first layer 3 of the paper web, as seen in FIGS. 1 and 2. Portions of the adhesive strip 6 pass through the perforations 4 and contact the upper surface of the second paper web layer 8 that underlies the leading portion 2 of the first paper web layer 3. This serves to fix or hold the first paper web layer 3 to the second paper web layer 8.

The two sided adhesive strip 6 can either completely or only partially overlie the line of perforations. In this way, the holding strength of the adhesive connection between the first outer paper web layer 3 and the second paper web layer 8 can be properly controlled. This holding strength is a function of the diameter "d" of each aperture 4, the axial spacing "a" between adjacent apertures 4 along the axial length of the paper web, and the portion or percentage of each aperture 4 which is covered by the two sided adhesive strip 6. In addition, the adhesive strength of the adhesive strip 6 can itself be adjusted. It is thus possible to very accurately control the holding force used to adhere the top paper web layer 3 to the second, underlying paper web layer 8. In this first preferred embodiment, the diameter of each perforation 4 is preferably between three to five millimeters. The axial spacing distance "a" between adjacent perforations 4 is between 50 and 100 millimeters. The double-sided adhesive strip 6 has a width "b" of between 12 and 50 millimeters. The perforations 4 are located in an area at the leading end 2 of the first paper web layer 3 which is close to the leading edge of the first paper web layer 3. There is a short distance "e" as discussed above, which in the preferred embodiment is at least 0.2 times the diameter "d" of the perforations. It would also be possible to provide two rows of perforations 4 which would be generally parallel to each other and which would both extend in the axial direction across the paper web supply roll.

It would also be possible to form the top paper web layer 3 having a leading portion 2 whose edge is not parallel with the axis of rotation of the paper web supply roll. This edge could extend obliquely to the axis of rotation, could have a V-shape, a W-shape or a double-W shape. In these instances, the edge 7 of the adhesive strip 6 could extend congruently with the end 2 of the first paper web layer 3. Alternatively, the edge 7 of the adhesive strip 6 could be parallel to and spaced from the leading edge of the first paper web layer 3. In these cases, the edge 7 of the adhesive strip 6 will be located in the start 2 of the first layer 3 of the paper web on the supply roll and not on the second layer 8 of the paper web.

The connection of the leading end 2 of the first or outermost paper web layer 3 of the fresh paper web supply roll to the web from an exhausting paper web supply roll in a so-called flying roll change, can be accomplished in a generally known manner, such as is described in German Patent Publication DE 42 10 329 A1. In this process, the exhausting paper web is brought into contact with an outer surface 11 of the adhesive strip 6 which has previously been applied to the leading end 2 of the first paper web layer 3 on the fresh paper web supply roll. The fresh paper web supply roll has been brought up to the appropriate rotational speed prior to such contact being made. The adhesive strip 6 will have been functioning as a holding adhesive since the portions of the adhesive strip 6 passing through the apertures 4 will have held the leading end 2 of the first paper web layer 3 in place on the second paper web layer 8. Once the outer surface 11 of the adhesive strip 6 has been brought into contact with the exhausting web by a suitable pressure roller or the like, the greater adhesive connecting force between the outer surface 11 of the strip 6 and the depleting web, as compared to the lesser adhesive holding force of the portions of the inner surface of the adhesive strip 6 passing through the perforations 4, will cause the leading portion 2 of the first layer 3 of the paper web to release from the second web layer 8 on the fresh supply roll and to adhere to the depleting web. Commercially available adhesive tape is suitable for use as the two sided adhesive strip 6. A roller or a guide roller can be placed in the path of the paper web travel, downstream of the pressure roller used to accomplish the flying roll change but still within the roll changer. This roller or guide roller, about which the outer surface of the paper web being removed from the paper supply roll will travel, can be provided with a means for deactivating the perforation shaped adhesive residue which may remain on the web. This adhesive residue deactivating agent can be silicon, a suitable powder, or the like.

Figure 3:
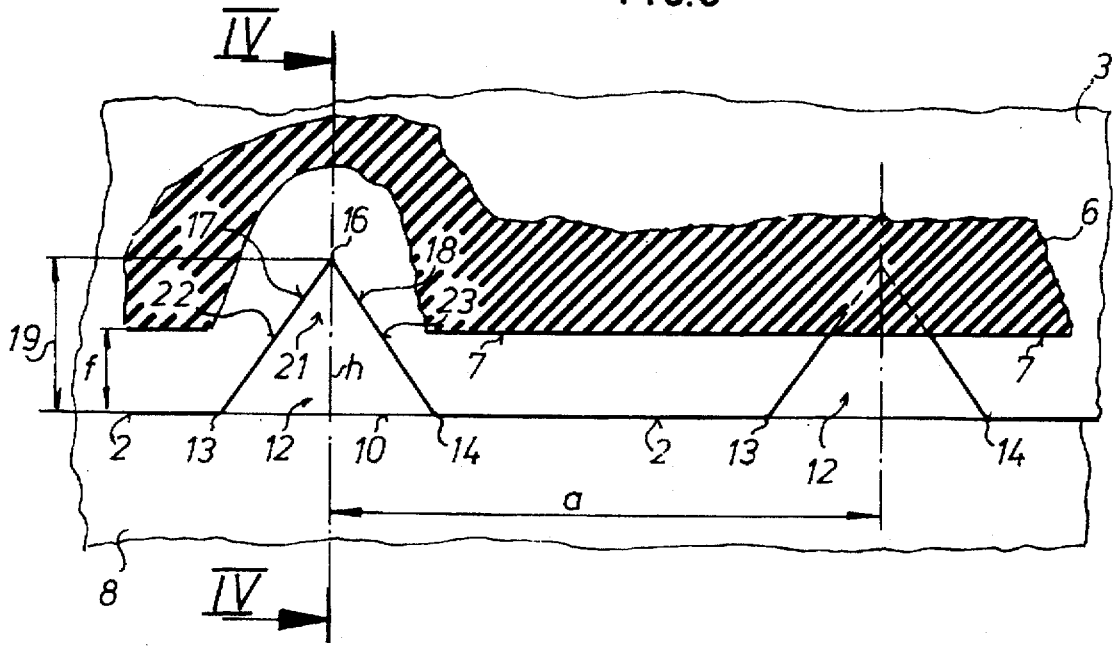
FIG. 3 is a partial top plan view of a second preferred embodiment of an adhesive arrangement for a leading end of a paper web.
Figure 4:
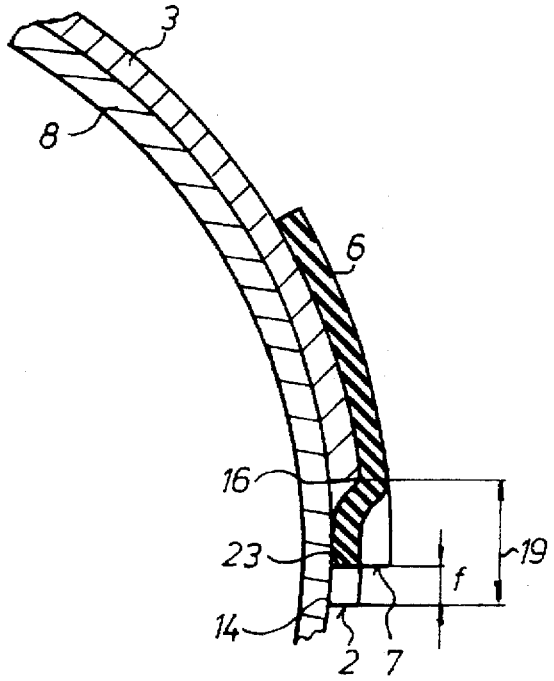
FIG. 4 is an enlarged cross-sectional view of the adhesive arrangement and taken along line IV—IV of FIG. 3.

Referring now to FIGS. 3 and 4, there may be seen a second preferred embodiment of an adhesive arrangement for a paper web supply roll in accordance with the present invention. In this second preferred embodiment, the same reference numerals will be used for corresponding elements. In this second preferred embodiment, the leading end 2 of the first paper web layer 3 on the fresh paper web supply roll is provided with a plurality of axially spaced apertures in the form of cut-outs 12. These apertures or cut-outs 12 extend parallel with the leading end 2 of the first paper web layer 3 and extend to the leading edge of the first paper web layer 3. As may be seen in FIG. 3, these apertures or cut-outs 12 are preferably triangular in shape and each has a base line 10 that is congruent with the paper web leading edge. The height "h" of each triangular cut-out 12 extends generally at right angles to the leading edge of the first paper web layer 3; i.e. is generally perpendicular to the axis of rotation of the paper web supply roll. Each base line 10 of each triangular cut-out or perforation 12 is limited at its ends by spaced end points 13 and 14. The height "h" of each triangular cut-out 12 is limited at a first end by the base line 10 that extends along the leading edge of the leading end 2 of the first paper web layer 3 of the paper web supply roll. The apex of each triangular perforation or cut-out 12 is designated at 16 and is the point of intersection of two inclined lines 17 and 18 that start at the base line points 13 and 14 respectively, and which cross at the point of intersection or apex 16.

The cut-outs 12 formed at the leading edge of the leading portion 2 of the first paper web layer 3 could also have a cross-section in the shape of a segment of a circle, whose secant extends on the paper web start 2 and corresponds to the base line 10. It is important that the geometrical shape of the cut-out 12 has a connection with the leading edge of the leading portion 2 of the first paper web layer 3 so that the cut-out is open along the leading edge of the first paper web layer 3. It is also important that the cut-out 12 have a reducing cross-sectional area in the direction extending away from the leading edge of the leading portion 2 of the first paper web layer 3 so that it tapers in the direction opposite to the direction of rotation of the paper supply roll and opposite to the direction of paper web travel. The cut-outs 12 thus reduce in area as they approach the apex or point of intersection 16 of the side lines 17 and 18.

As may be see by again referring to FIGS. 3 and 4, a two sided adhesive strip 6 has been applied to the leading end 2 of the first paper web layer 3. This adhesive strip 6 again functions as both a holding adhesive as well as a connecting adhesive during a flying roll change, as discussed in connection with the first preferred embodiment. The strip shaped adhesive 6 covers all or a portion of each of the generally triangular cut-outs 12 which are located in the strip shaped area 19 of the leading end 2 of the first paper web layer 3. This creates a plurality of generally triangular shaped adhesive surfaces 21 which engage the second paper web layer 8. Each such triangular shaped adhesive surface 21 is defined by the leading edge 7 of the adhesive strip 6 engaging the side lines 17 and 18 of the respective triangular cut-out or aperture 12 at the intersection points 22 and 23 and by the apex or intersection point 16 of the two lines 17 and 18.

In a manner similar to that discussed in connection with the first embodiment, the leading edge of the leading portion 2 of the first paper web layer 3 can be parallel to the axis of rotation of the paper supply roll, as depicted in FIG. 3. Alternatively, it can be oblique to the axis of rotation, can have a V-shape, a W-shape or a double-W shape. Similarly, the leading edge 7 of the adhesive strip 6 is either congruent with the leading edge of the first layer 3 of the paper web or it extends parallel to it but spaced from it by a strip-shaped spacing distance "f", as seen in FIG. 3. The width of this strip shaped spacing distance "f" may be, for example the same as the height "h" of the cut-out 12 or can be a portion of this height "h" so that the cut-outs 12 are either entirely or partially covered by the adhesive strip 6. This will again allow the holding strength which the adhesive strip 6 imparts to secure the leading portion 2 of the first paper web 3 to the second paper web 8 to be adjusted in a manner analogous to the first preferred embodiment. In this second preferred embodiment, the leading edge 7 of the two sided adhesive strip 6 is positioned either at the leading edge of the leading portion 2 of the first paper web layer 3 or back from this leading edge. It does not extend ahead of the leading edge onto the second paper web layer 8. The axial spacing distance "a" between the cut-outs 12 as well as the width "b" of the adhesive strip 6 may be generally the same as that discussed in connection with the first preferred embodiment.

While preferred embodiments of an adhesive arrangement for a paper web roll in accordance with the present invention have been set forth fully and completely hereinabove, it will be apparent to one of skill in the art that a number of changes in, for example, the overall size of the paper web supply roll, the structure of the roll changer, the type of paper web carried by the roll and the like could be made without departing from the true spirit and scope of the present invention which is accordingly to be limited only by the following claims.

What is claimed is:

1. An adhesive arrangement usable to prepare a paper web supply roll for a flying roll change comprising:

a first paper web layer on said paper web supply roll; said first paper web layer having a leading portion with a leading edge;

a plurality of apertures in said leading portion of said first paper web layer, each of said apertures in said plurality of apertures being spaced along said leading portion at a spacing distance from adjacent ones of said apertures;

a second paper web layer on said paper web supply roll, said second paper web layer underlying said apertures in said first paper web layer; and a single thickness, double sided adhesive strip having an inner holding surface and an outer connecting surface, said adhesive strip being applied to said leading portion of said first paper web layer parallel to said leading edge and at least partially overlying said apertures, portions of said holding surface of said adhesive strip passing through said apertures and contacting said second paper web layer to releasably secure said first paper web layer to said second paper web layer with a holding force, said holding force being less than a connecting force provided by engagement of said connecting surface of said adhesive strip with a paper web from an exhausting paper web supply roll during a flying roll change.

2. The adhesive arrangement of claim 1 wherein said apertures are located in said leading portion of said first paper web layer and at a small distance from said leading edge of said first paper web layer.

3. The adhesive arrangement of claim 2 wherein each of said apertures is generally circular.

4. The adhesive arrangement of claim 2 wherein each of said apertures has an arbitrary geometrical cross-sectional shape.

5. The adhesive arrangement of claim 1 wherein said apertures interrupt said leading edge of said leading portion of said first paper web layer.

6. The adhesive arrangement of claim 5 wherein each of said apertures has a generally triangular cross-sectional shape having a base line extending parallel to said leading edge of said first paper web layer and a height extending generally perpendicular to said base line.

7. The adhesive arrangement of claim 5 wherein each of said apertures has a cross-sectional shape in the form of a segment of a circle whose secant extends parallel to said leading edge of said first paper web layer.

8. The adhesive arrangement of claim 1 wherein said adhesive strip has a leading edge portion which extends parallel to said first paper web layer leading edge.

9. The adhesive arrangement of claim 8 wherein said adhesive strip leading edge portion and said first paper web layer leading edge are W-shaped.

10. The adhesive arrangement of claim 9 wherein said adhesive strip leading edge portion and said first paper web layer leading edge are V-shaped.

11. The adhesive arrangement of claim 9 wherein said adhesive strip leading edge portion and said first paper web layer leading edge are double-W shaped.

* * * * *